US006698055B2

(12) United States Patent
Haaga

(10) Patent No.: US 6,698,055 B2
(45) Date of Patent: Mar. 2, 2004

(54) SWEEPING MACHINE AND SWEEPING LIP

(75) Inventor: Hermann Haaga, Kirchheim/Teck (DE)

(73) Assignee: Ing. Haaga Werkzeugbau KG, Kirchheim/Teck (DE)

( * ) Notice: Subject to any disclaimer, the term of this patent is extended or adjusted under 35 U.S.C. 154(b) by 449 days.

(21) Appl. No.: 09/732,940

(22) Filed: Dec. 11, 2000

(65) Prior Publication Data

US 2001/0005916 A1 Jul. 5, 2001

(30) Foreign Application Priority Data

Dec. 10, 1999 (DE) ..... 199 59 562

(51) Int. Cl.[7] ..... E01H 1/04

(52) U.S. Cl. ..... 15/49.1; 15/41.1; 15/79.1; 15/87

(58) Field of Search ..... 15/41.1, 49.1, 15/79.1, 79.2, 83, 87, 340.4, 385

(56) References Cited

U.S. PATENT DOCUMENTS 1,514,949 A * 11/1924 Bell et al. ..... 15/347
5,231,724 A 8/1993 Haaga ..... 15/41.1
5,806,123 A * 9/1998 Tono ..... 15/49.1
5,896,611 A * 4/1999 Haaga ..... 15/79.1
5,920,939 A * 7/1999 Worwag ..... 15/41.1

FOREIGN PATENT DOCUMENTS

| | | |
|---|---|---|
| DE | 36 05 235 | 8/1987 |
| DE | 40 22 390 | 1/1992 |
| DE | 41 01 888 | 7/1992 |
| DE | 295 02 694 | 6/1995 |
| DE | 197 04 777 | 8/1998 |

OTHER PUBLICATIONS

German Patent Office Action referring to Documents AF–AJ, Aug. 18, 2000.

* cited by examiner

*Primary Examiner*—Theresa T. Snider
(74) *Attorney, Agent, or Firm*—Crowell & Moring LLP

(57) ABSTRACT

A sweeping machine of the type having two rotating brushes which in operation sweep material into a sweeping lip assembly is provided. In order to prevent damages to the sweeping lip, the forward area which in use contacts the ground during sweeping operations is configured upwardly elasticly deformable by weakening slots provided in reinforcement structure thereof and/or by different elastic characteristics of molded plastic material forming the sweeping lip.

16 Claims, 2 Drawing Sheets

SWEEPING MACHINE AND SWEEPING LIP

BACKGROUND AND SUMMARY OF THE INVENTION

This application claims the priority of German Patent Document No. 199 59 562.3, filed in Germany, Dec. 10, 1999, the disclosure of which is expressly incorporated by reference herein.

The invention relates to a sweeping machine with two driven circular brooms, which can be rotated in opposite directions with respect to each other and sweep over a sweeping plate provided with an elastic sweeping lip. In the operational state of the sweeping machine the sweeping lip is positioned at least partially flush with the ground.

Such a sweeping machine is known from the German Patent Document DE 41 01 888 C2 (corresponding to U.S. Pat. No. 5,231,724). The prior art sweeping machine exhibits in a front area of a sweeping machine housing two laterally arranged circular brooms that can be rotated toward the inside in opposite directions to each other. The two circular brooms are driven by one roller each. Each roller stands up on a floor and is positioned inside a bristle ring of each circular broom. The circular brooms' axes of rotation are sloped in such a manner relative to the sweeping machine housing that the bristles of the circular brooms sweep essentially over the front area of the ground. The circular brooms sweep the sweepings onto a sweeping lip, which is arranged between the circular brooms and whose front is mounted on a sweeping plate. The sweeping plate is positioned in front of a receptacle for the sweepings. The circular brooms sweep the sweepings over the sweeping lip onto the sweeping plate, where the sweepings are scraped off and thrown into the receptacle, located behind the sweeping plate, by means of the rotational movement of the circular brooms.

The sweeping lip is made of an elastic material and its ground-sided contact area is positioned essentially flush with the ground relative to the ground to be swept. Should the elastic is sweeping lip hit an impediment during a corresponding pushing movement of the sweeping machine, it can get caught on this impediment and be damaged.

An object of the invention is to provide a sweeping machine and a sweeping lip of the class described in the introductory part above that enables a flawless sweeping operation even under uneven ground conditions.

This problem is solved by preferred embodiments of the invention in that, starting from its ground-sided contact area, the sweeping lip is designed so as to be increasingly flexible in the direction of an upper-sided sweeping area so that, when the sweeping lip encounters an impediment, the front edge of the sweeping lip performs an automatic elastic avoidance movement in the upward direction. With the inventive solution the sweeping lip will perform with its front edge an avoidance movement in the upward direction upon encountering an impediment, whereby the sweeping lip can slide over the impediment. In the state of the art, however, an impediment could result in the sweeping lip overturning in the downward direction and thus result in damage or result in the sweeping lip detaching itself. During the analysis of these cases of damage, the solution of the invention arrived at the recognition that an automatic avoidance movement of the front edge of the sweeping lip in the upward direction upon encountering an impediment could avoid such problems and damage. Thus, the inventive solution combines increased rigidity of the sweeping lip in the ground-sided contact area with reduced rigidity in the upper-sided sweeping area. Thus, when the sweeping lip is subjected to compressive strain, the front edge of the sweeping lip automatically evades the impediment in the direction of the weak side and thus moves upwardly. In this manner an essentially improved sweeping operation is achieved that can be carried out without difficulty especially under uneven ground conditions. Such uneven ground conditions are found in particular on walkways with individual, protruding paving stones, in the area of flat curbstone corners, in the area of sewer covers and sewer holes and the like.

In the design of certain preferred embodiments of the invention the sweeping lip is molded as one piece to the sweeping plate. In contrast to the alternative solution that is also within the scope of the invention and in which the sweeping lip is fastened as a separate component to the sweeping plate in the front, a simplified manufacturability is achieved with this design.

In certain preferred embodiments of the invention, the upper-sided sweeping area of the sweeping lip exhibits material weakening structures. Such material weakening structures are preferably of a geometric nature, in that there are corresponding profilings in the area of the upper side of the sweeping lip.

In certain preferred embodiments of the invention, at least one reinforcement insert is integrated into the ground-sided contact area. Thus, the ground-sided contact area is reinforced relative to the upper-sided sweeping area so that the result is a desired varying rigidity between the top and bottom side, which can lead to an automatic elastic avoidance movement.

In certain preferred embodiments of the invention at least one notch, which runs at right angles to the normal direction of travel of the sweeping machine, is provided in the upper-sided sweeping area as the material weakening structure. This measure facilitates the vertical adjustment of the front edge of the sweeping lip in the upward direction upon encountering an impediment.

In certain preferred embodiments of the invention, the upper-sided sweeping area is formed by a softer elastomer material than the ground-sided contact area. During production of the sweeping lip this design is accounted for in that a nonhomogeneous elastomer mixture with correspondingly different properties is inserted between the bottom contact area and the upper sweeping area for the production of the sweeping lip. In so doing, both the ground-sided contact area and the upper-sided sweeping area exhibit a specific height, i.e. thickness, that can pass over flowingly into the other.

Other objects, advantages and novel features of the present invention will become apparent from the following detailed description of the invention when considered in conjunction with the accompanying drawings.

DETAILED DESCRIPTION OF THE INVENTION

Figure 1:
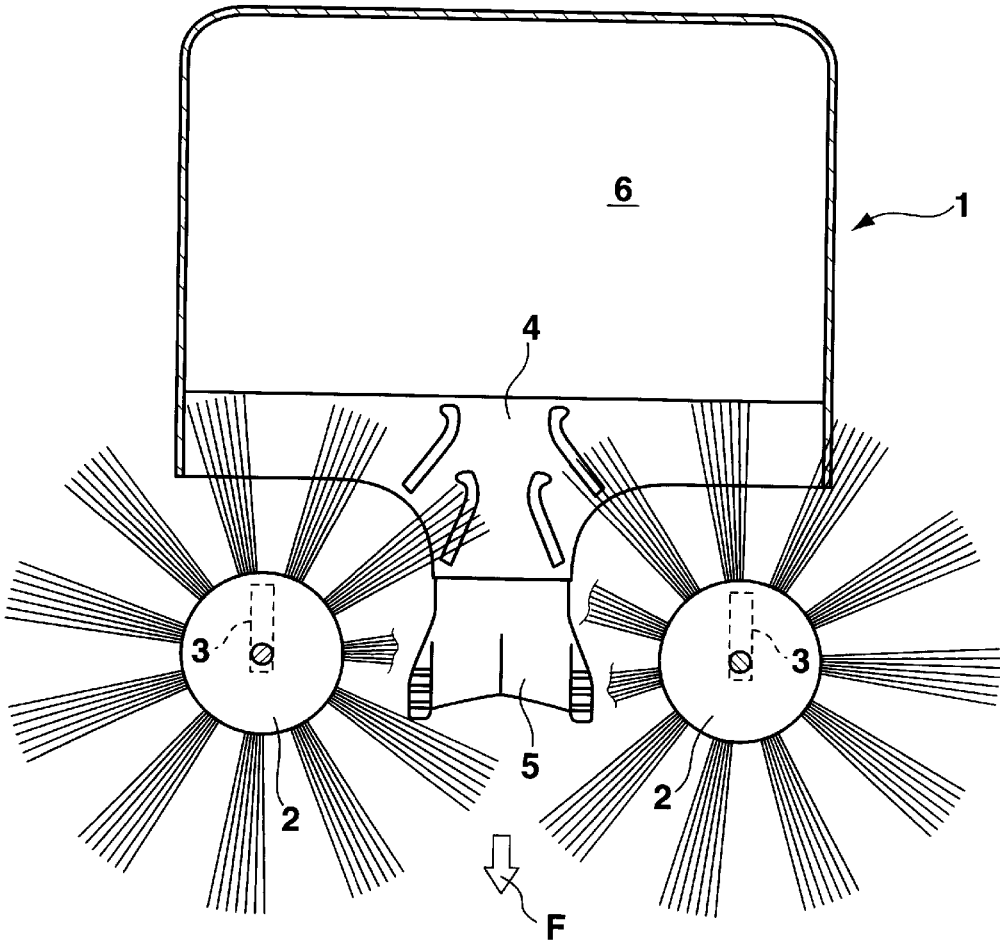
FIG. 1 is a schematic drawing of a cutout of a sweeping machine, constructed according to a preferred embodiment of the invention.
Figure 2:
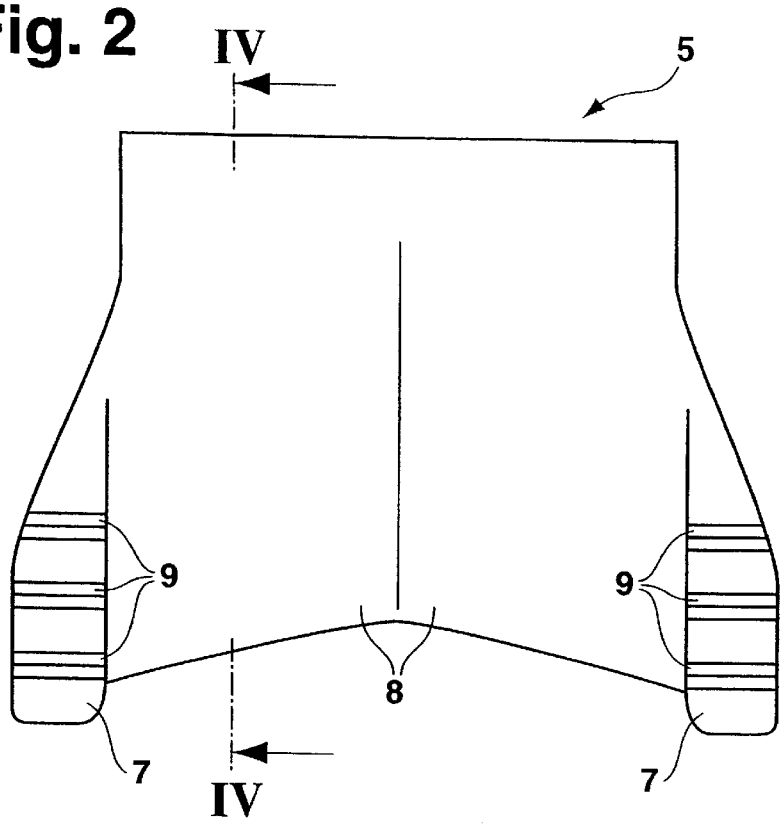
FIG. 2 is an enlarged representation of a sweeping lip of the sweeping machine of FIG. 1.
Figure 3:
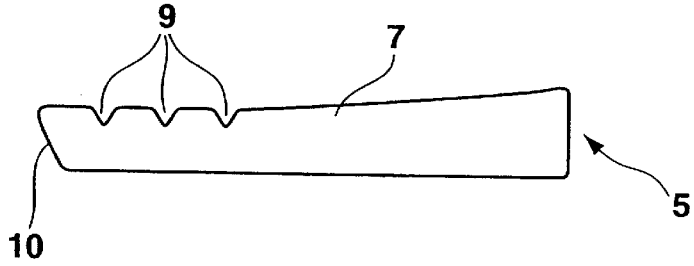
FIG. 3 is a side view of the sweeping lip shown in FIG. 2.

A sweeping machine 1, according to FIG. 1, corresponds in its basic operating principle to a sweeping machine, as disclosed in German Patent Document DE 41 01 888 C2 (corresponding to U.S. Pat. No. 5,231,724). Therefore, in addition to the following description, reference is made explicitly to the disclosure in this German Patent Document DE 41 01 888 C2 (corresponding to U.S. Pat. No. 5,231, 724), incorporated herein by reference thereto.

The sweeping machine 1 exhibits two circular brooms 2, which are arranged laterally in a front area and which are mounted so as to rotate in a sweeping machine housing (not illustrated in detail). In sweeping operation the sweeping machine 1 is pushed in the sweeping direction F. The circular brooms 2 are tilted in such a manner with their axis of rotation in the housing of the sweeping machine 1 that—based on the sweeping direction F—front-sided bristle bundles of the bristle ring of each circular broom 2 rest on a ground or substrate to be swept; and during the rotational movement the bristles of each bristle ring rise toward the inside and toward the rear and sweep over a sweeping lip 5 and a sweeping plate 4. The circular brooms 2 are driven by a drive wheel 3, which is positioned inside the circular broom and is designed as a follow-up wheel.

The sweeping plate 4 is mounted on the sweeping machine housing and bears in its front area the sweeping lip 5. The sweeping lip 5 is attached detachably to a front face edge of the sweeping plate 4. In certain preferred embodiments of the invention (not illustrated) the sweeping lip 5 is attached non-detachably to the sweeping plate 4 or is molded as one piece to said sweeping plate.

A rear-sided face edge of the sweeping plate 4 empties into a receptacle 6, which is connected detachably to the front-sided sweeping machine housing of the sweeping machine 1, in order to be emptied. The upper side of the sweeping plate 4 is provided with scraping edges (not labeled in detail) that facilitate the loosening of the sweepings from the bristles that sweep over the sweeping plate 4 and belong to each circular broom 2.

The sweeping plate 4 is positioned at a specific distance above the ground that is to be swept and over which the sweeping machine 1 drives. The distance between the sweeping plate 4 and the traveled over ground is maintained by, on the one hand, the drive wheels 3, braced against the ground, and, on the other hand, a rear-sided roller (not shown in detail) which is mounted in the area of a floor of the receptacle.

Figure 4:
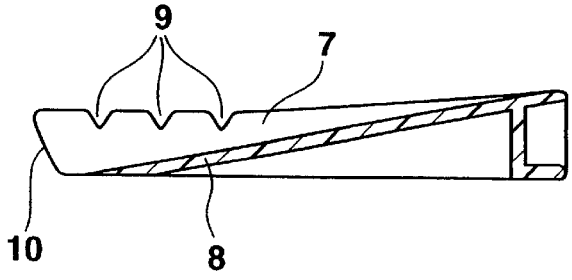
FIG. 4 is a sectional view along line IV—IV of the sweeping lip in FIG. 2.

In contrast, at least the front-sided face area of the front-sided arranged sweeping lip 5 rests on the ground in order to receive in the manner of a sweeping shovel even relatively fine sweepings, swept over the bristles of the circular brooms 2 onto the sweeping lip 5. The sweeping lip 5 is made as one piece from an elastic material and exhibits on the opposing sides two relatively dimensionally rigid runners 7, which flank a more flexible lip surface 8, which is designed thinner and elastic with respect to the runners 7. The lateral runners 7 serve to support and stabilize the intermediate, relatively thin walled lip surface 8 (FIG. 4), which forms the actual receiving surface for the sweepings. Provided on the front side are the two runners 7 with approach slopes 10, which facilitate sliding over the corresponding unevenness of the ground when there is a slight unevenness in the ground.

However, in the case of permanent impediments, whose height exhibits the height of the approach slope 10, the approach slopes 10 are largely functionless. To prevent even in these cases the sweeping lip 5 from turning over in the downward direction when driving over this impediment with its front-sided face edge, thus damaging the sweeping lip or detaching the sweeping lip from the sweeping plate 4, the lateral runners 7, which guarantee the dimensional stability and guide of the sweeping lip 5, exhibit material weakening structures in the shape of notches 9 in the upper-sided sweeping area, over which the bristles of the circular brooms 2 sweep. Each runner 7 is provided with three notches 9, which are aligned at equal intervals at right angles to the sweeping direction F and which exhibit an approximately triangular cross section. Owing to this material weakening each runner 7 is designed more flexibly in its upper area than in the bottom contact area, which rests against the traveled over ground. When the front face edge of a runner 7 or of both runners 7 encounters an impediment and when during the resulting compression strain the sweeping machine 1 is still pushed forward, the front edge of the sweeping lip 5, i.e. the front edges of both runners 7, evade in the upward direction. Thus, the sweeping lip 5 can slide over the impediment. The number and shape of the notches depend on the height of the desired vertical adjustment movement of the front edge of the sweeping lip 5. The increased elasticity in the upper sweeping area of the sweeping lip 5 must be designed in such a manner that the sweeping lip 5 is still adequately guided and rests on the ground during normal sweeping operation, i.e. without driving over an impediment. Therefore, the bottom, ground-sided area of the sweeping lip must still guarantee adequate dimensional stability.

In the non-illustrated embodiments of the invention, the automatic avoidance movement of the front face area of the sweeping lip in the upward direction is achieved by varying material properties between the upper sweeping area and the bottom contact area of the sweeping lip. In other embodiments of the invention the entire sweeping lip is designed relatively soft and is provided with reinforcement inserts in the bottom contact area. With said reinforcement inserts a reduced elastic flexibility in the bottom contact area is achieved so that—as in the case of the other described embodiments—after driving over a corresponding impediment and automatic raising of the front face area of the sweeping lip, the sweeping lip is automatically and elastically reset again into its uncompressed starting position.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. A sweeping machine comprising:

two driven circular brooms which can be rotated in opposite directions with respect to each other, and a sweeping plate over which the driven circular brooms sweep, said sweeping plate provided with an elastic sweeping lip which, in an operational state of the sweeping machine, is positioned at least partially flush with the ground, wherein, starting from its in use ground-sided contact area, the sweeping lip is designed so as to be increasingly flexible in a direction of an upper-sided sweeping area so that, when the sweeping lip encounters an impediment, a front face area of the sweeping lip performs an automatic elastic avoidance movement in the upward direction, and wherein the increasingly flexible design is achieved with at least one of a material weakening structure in the upper-sided sweeping area and a reinforcement insert in the ground-sided contact area.

2. The sweeping machine as claimed in claim 1, wherein the sweeping lip is molded as one piece to the sweeping plate.

3. The sweeping machine as claimed in claim 1, wherein the sweeping lip is fastened as a separate component to the sweeping plate.

4. The sweeping machine as claimed in claim 1, wherein at least one notch, which runs at right angles to the normal direction of travel of the sweeping machine, is provided in the upper-sided sweeping area as the material weakening structure.

5. The sweeping machine as claimed in claim 1, wherein the upper-sided sweeping area is formed by a softer elastomer material than the ground-sided contact area.

6. A sweeping lip for use with a sweeping machine of the type having two driven circular brooms which can be rotated in opposite directions with respect to each other, and a sweeping plate over which the driven circular brooms sweep, said sweeping plate provided with an elastic sweeping lip which, in an operational state of the sweeping machine, is positioned at least partially flush with the ground, said sweeping lip comprising:

an in use ground-sided contact area, an upper-sided sweeping area, and a front face area, wherein said sweeping lip is designed, starting from its in use ground-sided contact area, so as to be increasingly flexible in a direction of an the upper-sided sweeping area so that, when the sweeping lip encounters an impediment, the front face area lip performs an automatic elastic avoidance movement in the upward direction, and wherein said sweeping lip is made increasingly flexible with at least one of a material weakening structure in the upper-sided sweeping area and a reinforcement insert in the ground-sided contact area.

7. The sweeping lip as claimed in claim 6, wherein the sweeping lip is molded as one piece to the sweeping plate.

8. A The sweeping lip as claimed in claim 6, wherein the sweeping lip is fastened as a separate component to the sweeping plate.

9. The sweeping lip as claimed in claim 6, wherein at least one notch, which runs at right angles to the normal direction of travel of the sweeping machine, is provided in the upper-sided sweeping area as the material weakening structure.

10. The sweeping lip as claimed in claim 6, wherein the upper-sided sweeping area is formed by a softer elastomer material than the ground-sided contact area.

11. A sweeping plate assembly for use with a sweeping machine of the type having two driven circular brooms which can be rotated in opposite directions with respect to each other, and a sweeping plate over which the driven circular brooms sweep, said sweeping plate provided with an elastic sweeping lip which, in an operational state of the sweeping machine, is positioned at least partially flush with the ground, said sweeping plate assembly comprising:

a lip section which in use is disposed to accept sweepings from the brooms, and a rear section disposed in use behind the lip section and operable to guide sweepings to a sweeping machine receptacle, wherein said lip section includes flexibility inducing means operable to cause a front portion of the lip section to elastically deform in an upward direction and a portion of the lip section between the front portion of the lip section and the rear section of the sweeping plate assembly to elastically deform in a downward direction to thereby perform an automatic elastic avoidance movement of said front portion when impacted in use by an impediment on a ground surface being swept.

12. A The sweeping plate assembly according to claim 11, wherein said flexibility inducing means includes notches in reinforcement structures at the lip section.

13. The sweeping plate assembly according to claim 11, wherein said flexibility inducing means includes varying reinforcement structure at said front portion of the lip section.

14. The sweeping plate assembly according to claim 11, wherein said lip section and said rear section are molded as one piece.

15. The sweeping plate assembly according to claim 11, wherein the lip section is fastened as a separate component to the rear section.

16. The sweeping plate assembly according to claim 11, wherein the flexibility inducing means includes softer elastomer plastic material in forward sections of the front portion of the lip section as compared to more rearward sections.

* * * * *